United States Patent [19]

Kamberg

[11] Patent Number: 4,485,573

[45] Date of Patent: Dec. 4, 1984

[54] FLAT WORK IRONING ROLL WITH STRESS RELIEVING AXIAL EXPANSION SUPPORT

[75] Inventor: Eduard Kamberg, Chicago, Ill.

[73] Assignee: New Super Laundry Mach. Co., Inc., Chicago, Ill.

[21] Appl. No.: 424,109

[22] Filed: Sep. 27, 1982

[51] Int. Cl.[3] ..... D06F 67/02

[52] U.S. Cl. ..... 38/44; 100/93 RP; 165/90

[58] Field of Search ..... 38/44, 100; 100/93 RP; 165/89, 90; 308/DIG. 14; 34/124; 29/125

[56] References Cited

U.S. PATENT DOCUMENTS

| | | | |
|---|---|---|---|
| 2,322,957 | 6/1943 | Sullivan | 165/89 X |
| 2,956,348 | 10/1960 | Mueller | 165/89 X |
| 2,975,293 | 3/1961 | Justus et al. | 165/89 X |
| 2,987,305 | 6/1961 | Calhoun, Jr. | 165/89 X |
| 3,169,050 | 2/1965 | Kroon | 165/90 X |
| 3,331,434 | 7/1967 | Lockhart | 165/89 |
| 4,282,639 | 8/1981 | Christ et al. | 100/93 RP X |

*Primary Examiner*—Werner H. Schroeder
*Assistant Examiner*—Andrew M. Falik

[57] ABSTRACT

A commercial laundry flatwork finisher in the form of a rotatable hollow cylinder providing a circumferentially extending fuel cavity and a stationary self-contained interior heat source for heating the fluid in the cavity which in turn will uniformly heat the exposed cylindrical surface of the rotatable cylinder.

3 Claims, 2 Drawing Figures

FLAT WORK IRONING ROLL WITH STRESS RELIEVING AXIAL EXPANSION SUPPORT

SUMMARY OF THE INVENTION

The present types of commercial laundry flatwork finishers are heated by means of either gas, steam, oil, or electricity. Many of these particular types of flatwork finishers are installed in institutions, motels, hotels, and restaurants. The gas heated machine is by far the most popular, due to the economy of gas, its availability, and the fact that gas is a fast method of heating equipment of this nature.

However, certain disadvantages have always been associated with gas heating of this type of machinery. Due to the necessity of having to sense the temperature of the externally heated surface by conventional thermostatic heat controls there results a generally large differential in temperature across the ironing surface. Hot spots are created on the finishing surface when the operator fails to use the entire available finishing surface resulting in uneven temperature distribution across the surface resulting in unsatisfactory finished work or scorched material.

To eliminate the disadvantages of the commercial available flatwork finishers the present invention provides for an interior cavity in the flatwork finisher cylinder with such cavity being filled with a heat transfer fluid. The heat transfer fluid being in contact with the entire wall of the ironing surface evenly distributes the heat thereto.

A further object of this invention is to provide a heat exchanger which will more efficiently transfer heat more evenly over an enlarged surface, thus eliminating temperature fluctuations even when very heavy and extreme damp work is run through the machine.

Yet another object of the invention is to provide, through the heat exchanger, a more constant evenly disbursed heat whereby the machine may be continuously used at its maximum speed of operation.

In the present invention the finishing machine consists of a main heated cylinder which provides a polished surface. This external surface is heated internally with the work being finished adapted to pass over the exterior heated surface while being held in place with one or more padded pressure rollers and by a series of return ribbons.

It is an object of this invention to produce an even exterior heated surface which will permit the utilization of the machine at a greater speed of operation and which will permit a maximum surface temperature for accomplishing the finishing operation while avoiding the danger of overheating.

Without the present structure which provides a fluid cavity and the means for heat distribution, current machines have a tendency to overheat, and due to the speed at which the machines are operated, the operators have little opportunity to alternate the work across the entire heated surface thus resulting in hot spots. These hot spots can, in some cases, exceed the scorching point and cause serious linen damage plus damage to the machine itself.

Other objects will appear hereinafter.

DESCRIPTION OF THE DRAWINGS

The invention will be best understood by reference to the accompanying drawings which illustrate the preferred form of construction by which the stated objects of the invention are achieved, and in which.

GENERAL DESCRIPTION

Figures 1, 2:
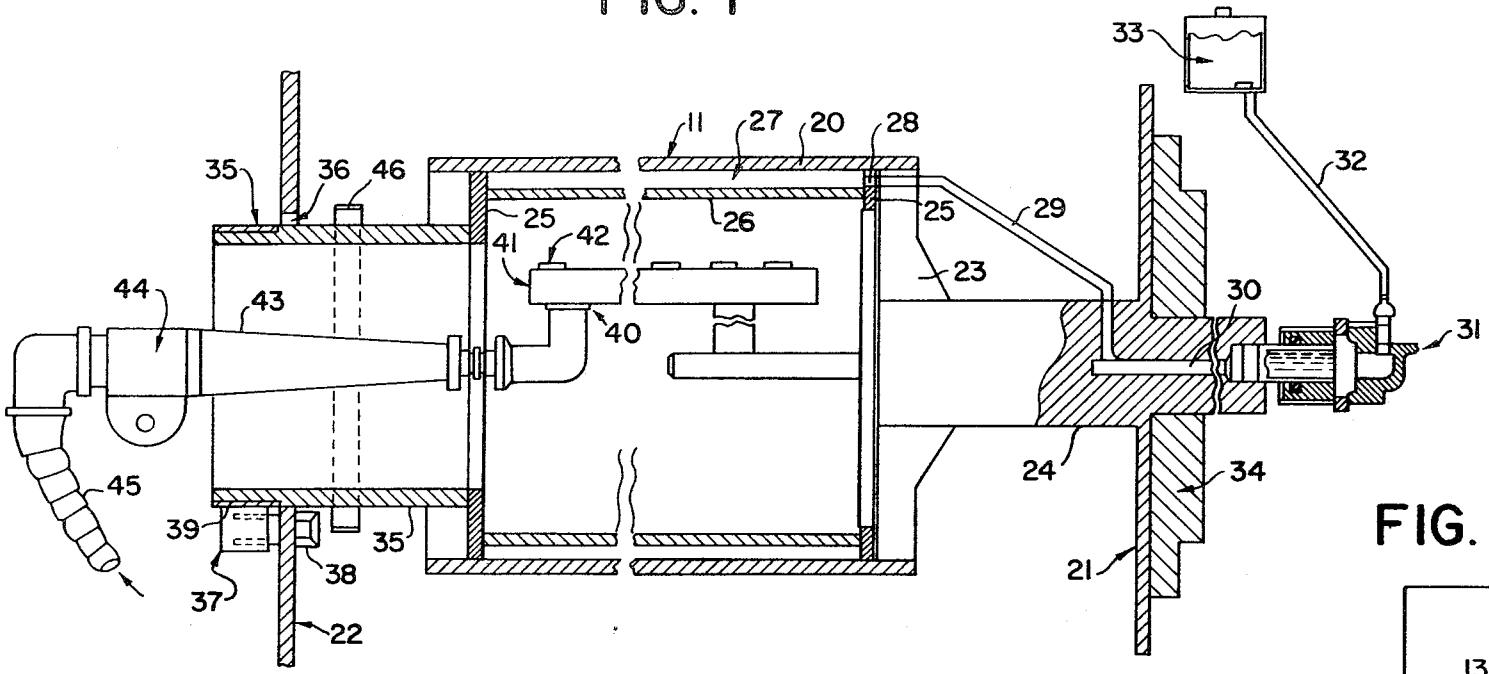
FIG. 1 is an enlarged fragmentary detailed sectional view of the internally heated finishing roller embodied in this invention.
FIG. 2 is a diagrammatic view of the structural arrangement incorporating the present invention in a commercial laundry finishing machine.

The commercial laundry flatwork finisher in which this invention is incorporated consists of a machine 10, which is diagrammatically illustrated in FIG. 1. The machine 10 includes the rotating heated finishing roller 11, the axis of which extends through an elongated horizontal plane. A feed drive roller 12, together with a receiving platform 13, cooperates to circulate a feed ribbon 14 so as to introduce the flatwork onto the periphery of the finishing roller 11. A series of pressure rollers 15 further entices movement of the work to be finished against the heated roller 11. By a series of rollers 16, 17, 18 and 19, over which a return ribbon 19' is threaded so as to move in the direction of rotation of the heated roller 11, the finished work is caused to move away from the heated roller 11 into a finished recovery position or onto a continuing conveyor.

The subject of this invention is the hollow heated cylindrical roller 11 and it is shown in structural detail in FIG. 1. As shown, the roller 11, including its outer cylindrical polished work surface 20 is adapted to be positioned between side frame plates 21 and 22. By means of suitable supporting gussets 23, one end of the roller 11 is connected to a rotatable supporting shaft 24.

Within each end of the roller 11 and secured to the inner wall of the polished work surface 20 are sprocket rings 25 and 25'. These rings 25 and 25' support an inner cylindrical wall 26 which is in spaced relation to the outer cylindrical wall of the roller 11, as shown in FIG. 1. Between the outer cylindrical wall of the roller 11 and the inner cylindrical wall 26 there is formed a fluid cavity 27. This fluid cavity, through a port 28 formed in the end ring 25', has connection to a fluid supply line 29. The fluid supply line 29, by a suitable channel 30 formed in the shaft 24, is connected to a rotary union 31. This rotary union 31 is of a type readily available in commerce and is well known in the art and makes up no part of the present invention except for its functional incorporation therein. By a suitable conduit 32 the rotatable union 31 is connected to a stationary fluid supply-expansion tank 33. It should be noted that the shaft 24 which carries the rotatable union 31 is rotatably mounted in a fixed bearing 34 carried by the side frame plate 21.

The opposite end of the roller 11 provides an axially extending tube 35 which is mounted to the internal ring 25. This tube 35 projects through an enlarged opening 36 formed in the side frame plate 22 and is freely supported on a cam bearing 37 which is mounted upon a carrier 38 provided by the frame plate 22. The exterior circumferential edge of the tube 35 is recessed and carries within the recess a cam ring 39.

By the foregoing description the roller 11 has its shaft 24 rotatably mounted in a fixed bearing 34, while at its opposite end the tube 35 is freely supported for rotation upon the cam bearing 37. This particular mounting is necessary as when the roller is heated and in operation it will axially expand between the side frame plates 20 and 21 and by the foregoing supporting arrangement the expansion is readily accommodated while the roller is maintained free to rotate about a horizontal axis.

To heat the fluid within the cavity 27 there is provided within the roller 11 a heat source 40. As shown the heat source 40 constitutes a gas burner manifold 41 which provides a plurality of burner tips 42. The manifold 41, by a suitable conduit 43, is connected to a combustion mixer 44 which in turn is connected to an air source by flexible conduit 45, as shown, and a combustible fluid supply not shown.

To rotate the roller 11 there is secured to the tube 35 a sprocket wheel 46 which in turn may be operatively connected to a drive source, not shown.

A suitable temperature gauge may be associated either by being immersed in the heated fluid in the fluid cavity 27 or by being in physical contact with the exposed cylindrical surface of the roller 11.

From the foregoing it is apparent that I have disclosed a rotatable flatwork finishing roller 11 which includes a fluid cavity that in turn is heated by a stationary heat source.

As the roller 11 is caused to rotate about a horizontal axis, the fluid within the cavity 27 will, by inertia, cause to be activated within the cavity 27. The heat source 40 being stationary, continuously heats the inner wall surface of the fuel cavity 27 as it is caused to rotate about the heat source. By this arrangement, there is established an even heated surface for the roller 11 which would permit the machine to operate at a more continuous and greater speed than a comparable commercially available roller. The surface temperature of the roller 11 may reach a maximum temperature of approximately 400° F., and still avoid the danger of overheating. Without the fluid cavity and the means of heat distribution as heretofore described, prior machines have a tendency to overheat and due to the speed at which such machines are operated, the operators have little opportunity to work across the entire surface resulting in hot spots. These hot spots can reach temperatures of scorching or approximately 440° F., and can cause serious linen damage in addition to damage to the machine itself.

I have also described means of rotatably supporting the roller 11 which will accommodate longitudinal expansion parallel to its axis due to the heating of the metallic surfaces. This is accomplished through the bearing journal which includes the cam bearing 37 operable upon the cam ring 39.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to secure by Letters Patent is:

1. A laundry flatwork finisher comprising, (a) an elongated hollow roller providing a polished circumferential outer finishing surface, (b) means for rotating said roller about a horizontal axis, (c) a circumferentially extending fluid cavity behind said finishing surface, (d) a supply-expansion tank for supplying a heat transfer medium into said fluid cavity through a rotary union, (e) a stationary heat source within said hollow roller for heating said heat transfer medium in said cavity as the same rotates about its horizontal axis, (f) means providing a fixed horizontal axis for one end of said roller and providing a free roller bearing at the opposite end of said roller for permitting longitudinal axial movement of said roller relative to said fixed horizontal axis due to heat expansion of said roller, and (g) said means providing a fixed horizontal axis for one end of said roller comprises a horizontal shaft connected to said roller and extending out of one end thereof, and with said free roller bearing at the opposite end of said roller comprising a rotatable supporting cam upon which freely rotates a cam ring provided by said opposite end of said roller.

2. A laundry flatwork finisher as defined by claim 1, wherein said stationary heat source comprises a gas burner manifold extending parallel to the horizontal axis of said roller with said manifold providing a plurality of heat producing burner tips in juxtaposition to one wall of said fluid cavity so as to uniformly heat the heat transfer medium therein.

3. A laundry flatwork finisher as defined by claim 2, wherein said means for supplying a heat transfer medium into said fluid cavity includes a supply-expansion tank communicating through a rotary union with said fluid cavity.

* * * * *